US005439153A

United States Patent [19]

Murdoch et al.

[11] Patent Number: 5,439,153

[45] Date of Patent: Aug. 8, 1995

[54] ALL WEATHER COVER

[75] Inventors: Douglas Murdoch, Santa Rosa, Calif.; Uwe Mummenhoff, Toronto, Canada

[73] Assignee: Daymen Photo Marketing Ltd., Scarborough, Canada

[21] Appl. No.: 130,143

[22] Filed: Oct. 6, 1993

Related U.S. Application Data

[63] Continuation-in-part of Ser. No. 974,028, Nov. 20, 1992, abandoned.

[51] Int. Cl.[6] ..... A45C 15/00

[52] U.S. Cl. ..... 224/151; 224/208; 224/224; 224/240; 224/153; 150/159; 383/4; 206/315.3

[58] Field of Search ..... 224/151, 153, 154, 155, 224/186, 188, 190, 191, 201, 202, 209, 208, 210, 213, 215, 224, 228, 235, 236, 237, 240, 241, 259, 261, 262, 923; 206/315.3; 383/4; 190/26, 109, 110, 111; 150/105, 114, 154–159, 901

[56] References Cited

U.S. PATENT DOCUMENTS

| | | | |
|---|---|---|---|
| 2,704,563 | 3/1955 | Henrich . | |
| 3,989,080 | 11/1976 | Koszegi | 224/151 |
| 4,078,264 | 3/1978 | DeGennaro et al. . | |
| 4,865,191 | 9/1989 | Easter | 206/315.3 |
| 4,953,768 | 9/1990 | Muse | 206/315.3 |
| 5,014,846 | 5/1991 | Walker et al. . | |
| 5,154,332 | 10/1992 | Williams et al. | 224/153 |
| 5,280,798 | 1/1994 | Helm . | |

FOREIGN PATENT DOCUMENTS

| | | | |
|---|---|---|---|
| 233097 | 8/1987 | European Pat. Off. . | |
| 580764 | 11/1924 | France . | |
| 2391671 | 12/1978 | France | 224/209 |
| 2669518 | 5/1992 | France | 224/215 |
| 2948713 | 6/1981 | Germany | 224/153 |
| 4226964 | 2/1994 | Germany | 224/209 |
| 5228230 | 9/1993 | Japan . | |
| 376766 | 7/1932 | United Kingdom | 206/315.3 |
| 1539778 | 2/1979 | United Kingdom | 224/213 |
| 2197582 | 5/1988 | United Kingdom | 224/215 |
| 9304610 | 3/1993 | WIPO . | |

*Primary Examiner*—Henry J. Recla
*Assistant Examiner*—Gregory M. Vidovich
*Attorney, Agent, or Firm*—Bereskin & Parr

[57] ABSTRACT

A protective cover for bags which may be carried by means of a harness or waist belt such as shoulder bags, fanny packs and the like is described. In order to provide additional protection against inclement weather, the bag comprises a pocket having a fastener and into which a cover of flexible water resistant material may be folded when the cover is stored. When additional protection for the bag is desired the pocket is opened and the cover unfolded from the pocket. The pocket contains the hinge joining the cover to the bag. The cover then extends around the bag to provide a water resistant covering extending over at least those sides of the bag which have openable flaps through which leakage may occur. The cover extends around but does not cover the harness so that the harness is still available for its intended use.

12 Claims, 6 Drawing Sheets

ALL WEATHER COVER

This application is a continuation-in-part of U.S. application Ser. No. 07/974,028, now abandoned, filed on Nov. 20, 1992.

FIELD OF THE INVENTION

This invention relates to the field of protective covers for bags which may be carried by means of a harness.

BACKGROUND OF THE INVENTION

Many types of bags have been designed for specific uses. Photographers, in particular, require bags which are adapted to carry photographic equipment and supplies in a manner that will protect that equipment and supplies. In some cases, particularly in the field of nature photography and the like, rather large amounts of equipment are carried in significantly large bags. In view of the size of the bags and the amount of the equipment carried, such bags are often fitted with harnesses so that the bags may be carried like a backpack. In other cases, where relatively smaller amounts of equipment are carried, the bag may be of a more convenient size but is often equipped with a strap or harness in order that the bag may be carried by means of a strap which would be looped over one shoulder of the photographer or passed around the waist.

Quite apart from the photography field, there are other specialized bags of a similar nature. Outdoors persons generally are familiar with backpacks which may be used to carry all manner of camping supplies or other supplies. There is also a wide range of smaller bags carried in shoulder straps and the like for carrying other than photographic supplies.

One common feature of these types of bags is that they are carried in all kinds of weather. Such bags during good weather conditions provide sufficient protection for the goods carried within the bags. However, in inclement weather such bags may leak water or admit fine dust.

Most bags are arranged with some type of openable flap having closure means which extend around the upper portion of the bag. In addition, the bag may have one or more compartments each of which is accessible through a hinged flap having closure means. The usual type of closure is a zipper. Other types of closures such as hook-and-loop materials such as that sold under the trade mark VELCRO may be used. Snap fasteners and the like may also be used as appropriate.

It is usually desired that the bags be manufactured from lightweight but strong material. To this end, many bags are now manufactured from nylon products which are soft sided but still give the required protection by means of inserts or the like which provide against crushing of the equipment carried in the bag.

When the traditional bag is carried in inclement weather there arises the danger of leakage through the bag material itself or through the closures. As the bags are often equipped with a number of different pockets for various size articles, there are often a number of such closures, and some or all of those closures may leak.

SUMMARY OF THE INVENTION

In accordance with this invention, additional protection for the bag and its contents in inclement weather is provided by an encompassing cover. The cover is intended for use with a bag that can be carried by a human being and which is equipped with a harness. In this specification and claims, the word harness is used to encompass any type of strap which may be used to support the bag on one or both shoulders of a person carrying the bag or which may encircle the waist of the wearer. The bag will comprise a housing which may be divided into one or more compartments. The cover for the bag is constructed from a flexible water resistant material. The cover has a hinged portion and a free edge portion. The bag comprises a closable pocket which is adapted to contain the cover when it is in its folded condition and in which the cover is stored when not required. The pocket thus contains the hinge which attaches the cover to the bag. The cover is large enough to substantially enclose the bag to protect the surfaces of the bag that would be subject to inclement weather when the bag is carried by means of the harness or when resting on the ground. In particular, the cover is large enough to extend over all openable flaps of the bag to protect against leakage through the closures of the flaps. dr

DESCRIPTION OF THE DRAWINGS

Further and other features of the invention will be more clear from reference to the enclosed drawings which illustrate preferred embodiments and in which.

DESCRIPTION OF THE PREFERRED EMBODIMENTS

Figure 1:
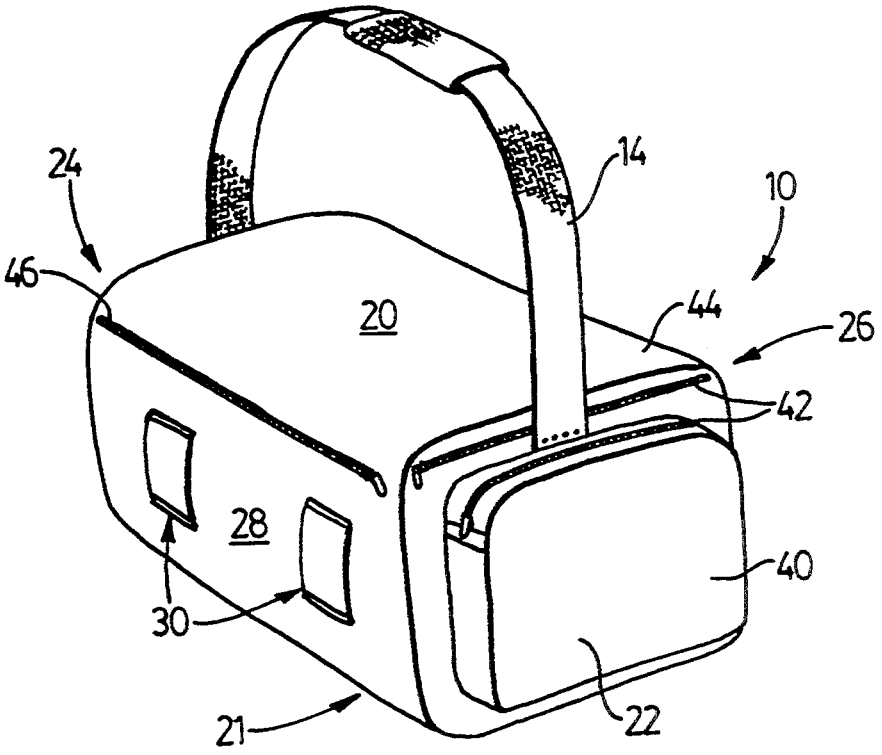
FIG. 1 is perspective view of a shoulder bag in accordance with the invention showing the top, back and right surfaces of the shoulder bag.

FIG. 1 illustrates a bag, generally indicated by the reference numeral 10, which is sometimes referred to as a "shoulder bag". The shoulder bag 10 may be used by photographers, campers and outdoorsmen generally, typically on short duration excursions outdoors. The shoulder bag may be fitted with impact resistant padding to protect the bag's contents, such as fragile camera lenses or the like.

The shoulder bag 10 has a harness 14 which is adapted to be looped over one shoulder of the person carrying the bag. The shoulder bag 10 comprises an upper surface 20, a lower surface 21, right and left side surfaces 22 and 24, and front 26 and back 28 surfaces. The back surface 28 will be adjacent the hip or side of the person carrying the bag. However, the back surface 28 may also be equipped with two or more rectangular pieces of webbing 30, sewn at either end to the back surface 28, to allow a waist belt or a comparable harness (not shown) to be slid through the openings formed by the webbings 30. The shoulder bag 10 may therefore be worn about the wearer's waist with the back surface 28 bearing against the wearer's lower back, for example.

Figure 2:
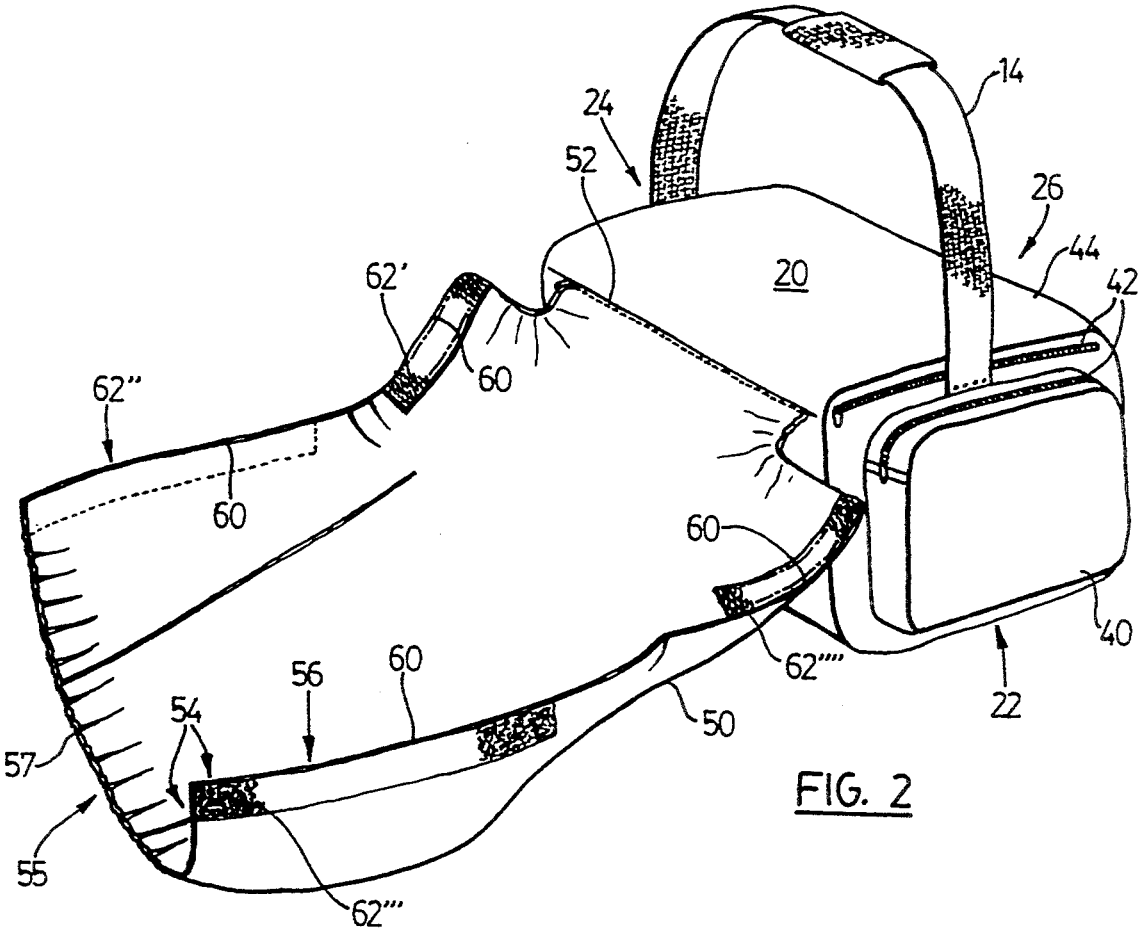
FIG. 2 is a perspective view of the bag of FIG. 1 but showing the inner surface of the cover unfurled from its pocket.
Figure 3:
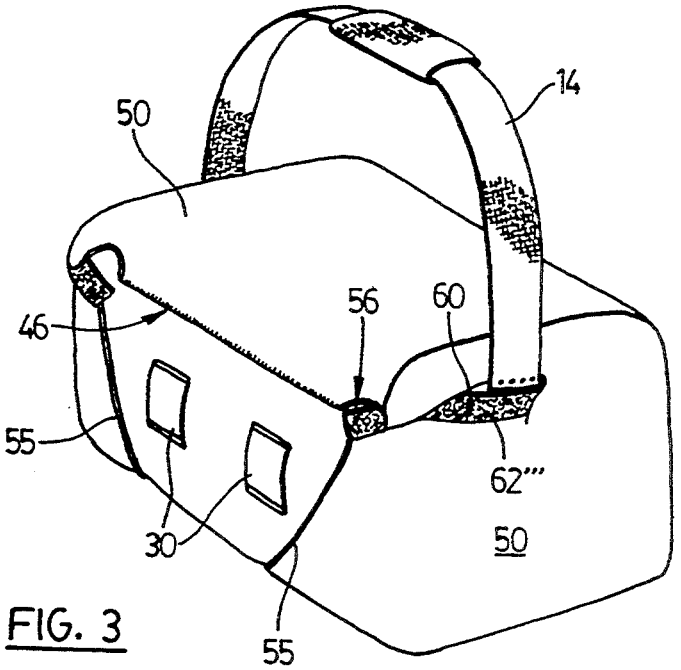
FIG. 3 shows the bag of FIGS. 1 and 2 with the cover in place on the bag.

The shoulder bag 10 illustrated in FIGS. 1–3 will have a number of compartments 40 on the right, left and front surfaces 22,24 and 26 to hold various pieces of equipment and supplies. A closure means 42 (a zipper, for example) provides access to each of the compartments 40. A lid 44 and a corresponding closure means 42 extending around the right, left and front surfaces 22, 24 and 26 provides access to the interior of the bag 10. The top of lid 44 may also include, if desired, a small pouch and/or a handle (not shown) for carrying the bag 10. It will be appreciated by those skilled in the art that the closure means 42 and any seams in the bag are subject to leakage in inclement weather.

The back surface 28 of shoulder bag 10 also has a pocket 46 and associated closure means. Pocket 46 is large enough to accommodate a cover 50 shown in FIG. 2 in its unfurled position out of the pocket. The cover 50 has a hinged portion 52 within the pocket 46 and a free edge portion 54 having a first portion 55 and a second portion 56.

In order to install the unfurled cover 50 on the bag 10 to provide protection in inclement weather, the cover 50 is first drawn upwardly and sideways over the lid 44, then downwardly over the front surface 26, and then across the lower surface 21 until a part of the free edge portion 54 extends across the back surface 28 on either side of the webbings 30, as shown in FIG. 3. As this is being done, part of the cover 50 is also extended over the right and left side surfaces 22, 24. It is therefore understood that the cover 50 should be large enough that it can be wrapped about the bag 10 on all sides on which compartments 40 are situated, as shown in FIG. 3 (note that FIG. 3 shows the bag 10 from the back surface 28 with a view similar to that in FIG. 1). FIG. 3 therefore illustrates the bag 10 with the cover 50 in place. To ensure that the shoulder harness 14 remains accessible, the cover 50 is provided with appropriate slits or reliefs 60 in the second portion 56 of the free edge 54 so that the shoulder harness fixation points remain accessible, thus allowing use of the harness 14 when the bag 10 is covered. The slits 60 are formed (ie. "closed") about the fixation points of the harness by a closure means 62 (illustrated as 62', 62'', 62''' and 62'''' in FIG. 2 and FIG. 3), such as hook-and-loop fasteners, as illustrated in FIGS. 2 and 3.

The first portion 55 of the free edge 54 of the cover 50 may be provided with an elasticized band 57, drawstring, or the like, if desired, to help hold the cover in place on the bag.

It will be observed that the free edge portion 54 leaves a panel which includes most of the back surface 28, exposed. In particular, the webbings 30 should remain exposed on the panel so that the bag 10 may be worn on the waist belt when the cover 50 is in place. The waist belt can be passed under the webbings 30 to affix the waist belt to the pack. Even if moisture or other inclement weather comes into contact with the panel of the back surface 28, there is very little danger of leakage since there are no openings or compartments on that panel.

Figure 4:
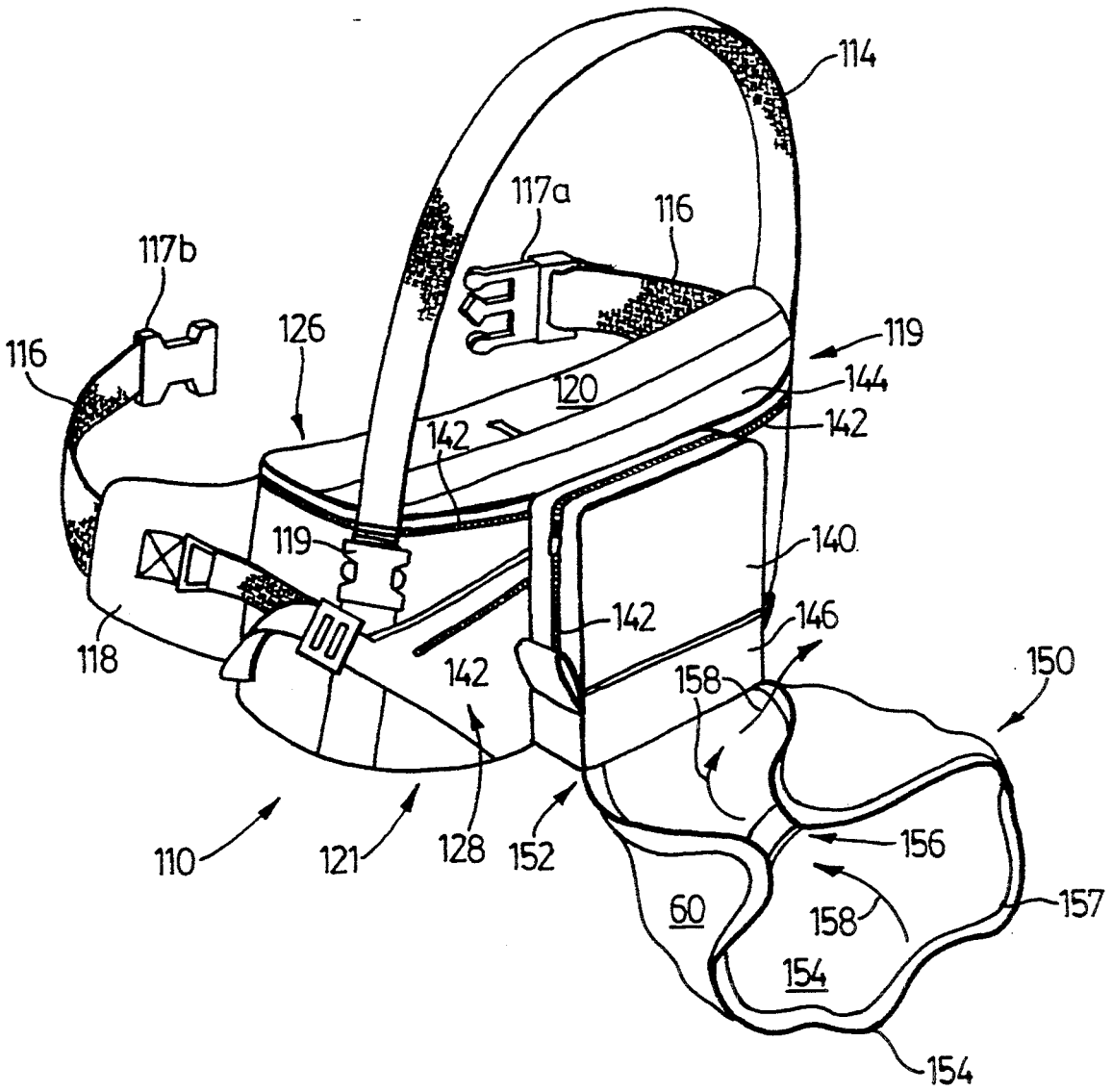
FIG. 4 is a perspective view of a fanny pack in accordance with the invention showing the top, front and right surfaces of the pack and a cover unfurled from its pocket in an inverted orientation.
Figure 5:
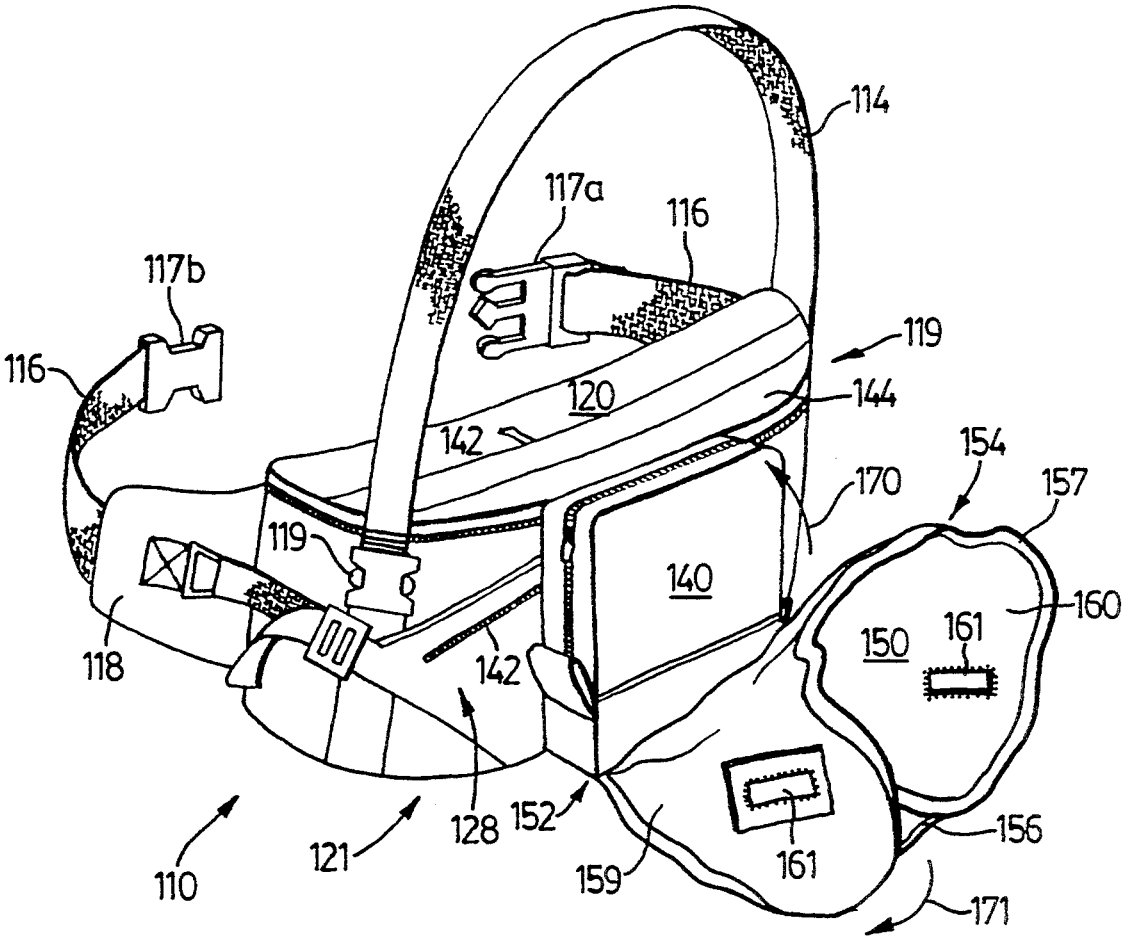
FIG. 5 shows the pack of FIG. 4 with the cover in a proper orientation for installation over the pack.
Figure 6:
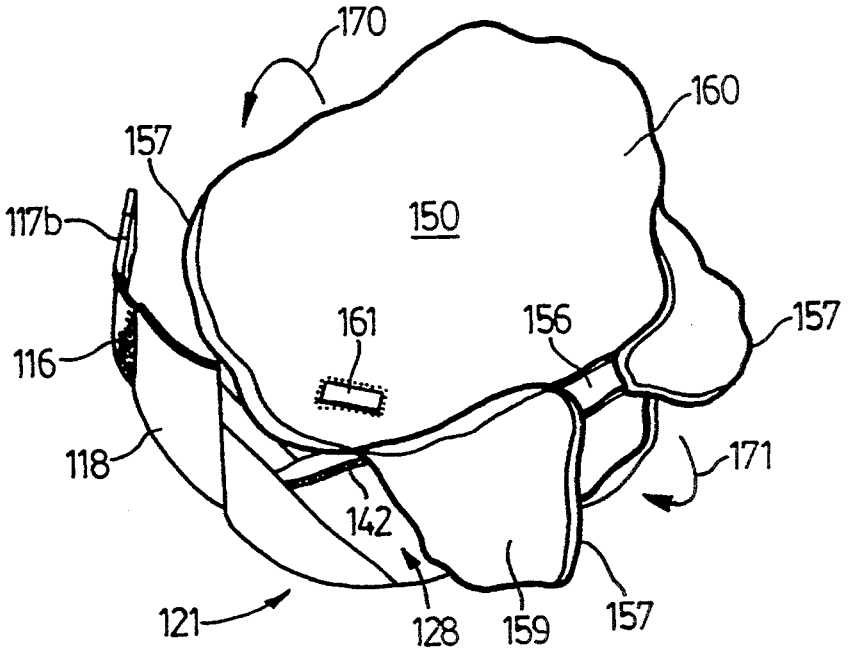
FIG. 6 shows the pack of FIGS. 4 and 5 with the cover partially installation over the pack.

Another version of both the bag 10 and the cover 50, indicated by the reference numerals 110 and 150, respectively, is shown in FIGS. 4 to 6. For ease of reference, those features on the bag 110 and the cover 150 which are similar to those on the bag 10 and the cover 50 will share the same reference numerals, with the addition of a prefix "1".

The bag 110 illustrated is often referred to as a "fanny pack" since a waist belt 116 is attached to the pack 110 and is worn about the wearer's waist, with the body of the pack 110 located near the base of the wearer's back. The waist belt 116 has a buckle 117 with a male potion **117*a* and a female portion 117*b*, and cushioned portions 118 adjacent each side of the pack 110 for a more comfortable fit about the wearer's waist. The pack 110 also has a shoulder harness 114 detachably connected to the pack 110 with buckles 119 (of similar construction to buckle 117**) on either end to provide the user with the option of carrying the pack on one shoulder.

The pack 110 has an upper surface 120, a lower surface 121, a generally rounded back surface 128 and a front surface 126. The front surface 126 is preferably padded for a comfortable fit against the wearer's back when the waist belt 116 is used. The waist belt 116 may be buckled around the other side of the pack 110 (ie. opposite to that shown in FIG. 4) and the front surface will be adjacent the wearer's hip when the harness 114 is used. The pack 110 has a compartment 140 on the back surface 128, and a closure means 142 provides access to the compartment 140. A lid 144 and a corresponding closure means 142 extending around the top of the pack 110 from one side of the compartment 140 to the other side as shown provides access to the interior of the bag 110.

A lower pocket 145 of the compartment 140 has a closure means underneath (not shown) and is large enough to accommodate a cover 150. The cover 150 has a hinged end 152 within the lower pocket 146 and a free edge portion 154. A short, elongate elastomeric band 156 is connected at each of its ends to the free edge portion 154. The entire free edge portion 154 in this embodiment should have an elasticized band 157. When the cover 150 is withdrawn from the pocket 146, it will look like either that shown in FIG. 4 or 5. If it looks like that shown in FIG. 4, then it should be inverted (by moving the free edge portion 154 which is furthest from the pocket 146 underneath the band 156 in the direction of arrows 158) to resemble the orientation of the cover 150 in FIG. 5.

In the FIG. 5 orientation, the cover 150 has an inner surface 159 and an outer surface 160. The terms "inner" and "outer" are used to indicate the location of these surfaces once the pack 110 is covered. In order to install the unfurled cover 150 of FIG. 5 to provide protection in inclement weather, the inner surface 159 of the cover 150 is first drawn over the upper surface 120 and toward the waist belt 116 (as indicated by arrow 170 in FIGS. 5 and 6) until the elasticized band 157 of the cover 150 is located at about the level of the closure means 142 of the lid 144 along the front panel 126. Then the remaining (unstretched) part of the elasticized band 157 of the cover 150 is pulled underneath the pack 110 toward the waist belt 116 (following the arrow 171 in FIGS. 5 and 6). Once the cover 150 is securely fitted, the buckles 119 (unclipped from the harness 114) may be pushed through apertures 161 so as to be accessible to the harness 114.

With the cover 150 installed over the pack 110, the upper surface 120 and the back surface 128, including any compartments 140 and closure means 142, should be covered by the cover 150 to ensure full protection against inclement weather. A part of the lower surface 121 in this embodiment remains uncovered by the cover 150 since it is bereft of compartments and closure means, and a panel on the front surface 126, remains substantially exposed to retain access to the waist belt 116.

The covers 50 and 150 as illustrated and discussed above provide complete encapsulating protection for the bag at least on all sides wherein there is an openable compartment and can extend over all sides of the bag or pack if desired. In order to do so, it is only necessary to provide a cover of a complimentary shape so that it can completely enclose the outside surface of the bag or pack.

The cover 50 and 150 may advantageously be manufactured from a single sheet of flexible water resistant material such as treated ripstop nylon or the like. The cover must itself be water resistant so that rain, snow, sand, dust and the like cannot enter into the bag when the cover is in place. While advantageously the covers 50 and 150 are one piece covers, it is not necessary that the covers be manufactured from a single sheet of water resistant material.

While the location of the pockets 46 and 146 containing the covers 50 and 150, respectively, have been illustrated in the specific examples discussed herein, it will be apparent that the pocket into which the cover is folded when not in use may be located on any portion of the bag. Advantageously, the cover pocket is so arranged so that the pocket will not itself become accessible to inclement weather conditions. This may normally be accomplished by arranging the pocket either in the bottom surface of the pack or bag as carried or in a surface which is adjacent to the body of the wearer so that the portion of the surface, if any, which is not completely enclosed by the cover is adjacent the body of the wearer and thus is protected for inclement weather conditions.

Figure 7:
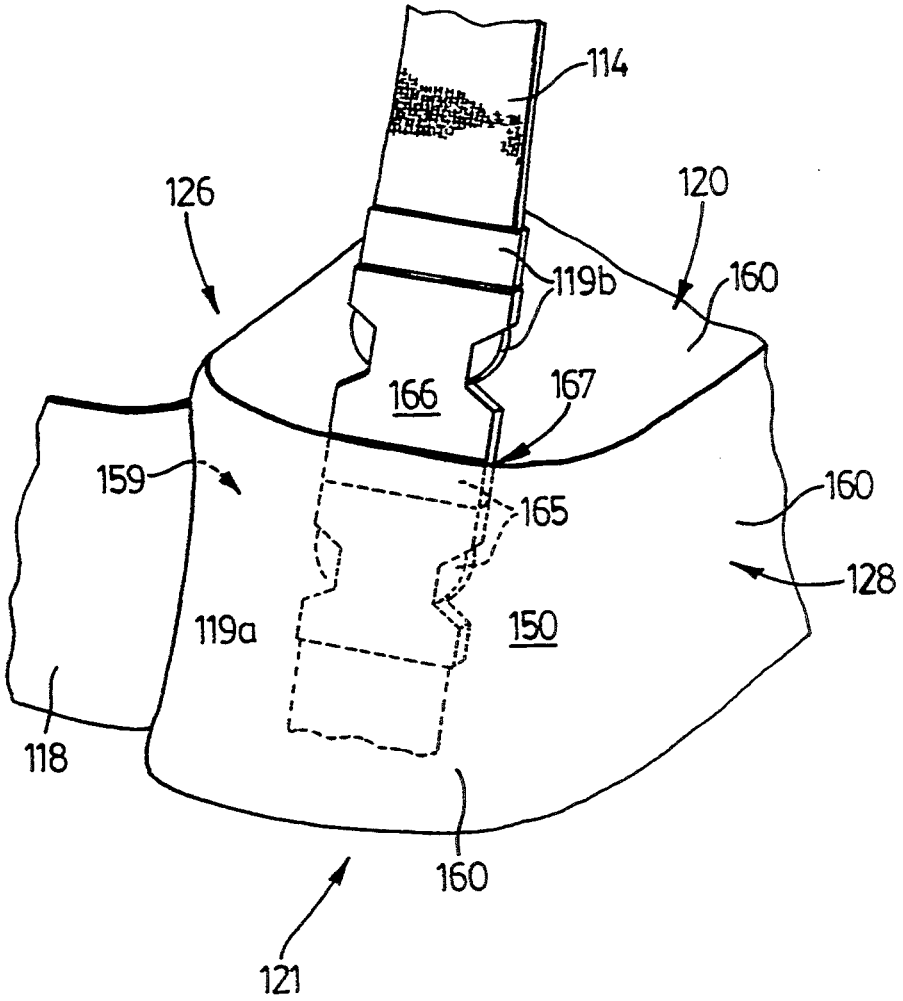
FIG. 7 shows an alternate embodiment of the cover with a system of buckles to transfer load from a pack or bag to a harness.

As an added measure of protection against the invasion of any inclement weather into the pack 110, for example, the apertures 161 for the buckles 119 may be omitted entirely and substituted by a direct load transfer arrangement on the cover as illustrated in FIG. 7. FIG. 7 shows a portion of the pack 110, closest to the viewer in FIG. 5, enclosed by the cover 150. The female portion of the buckle 119 (indicated by 119*a*) attached to the pack 110 is underneath the cover 150, as indicated in dotted outline. A complimentary male buckle 165, attached to the inner surface 159 of the cover 150, is joined to the female portion 119*a* of the pack's buckle 119. Another female buckle 166 is attached to the outer surface 160 of the cover 150 along attachment line 167 adjacent the cover's inner male buckle 165. This female buckle 166 is in turn used to connect to the male portion of buckle 119 (indicated by reference number 119*b*) on harness 114. It will therefore be appreciated that load from the pack 110 is transferred directly to the harness 114 and the wearer's shoulder through the female portion of buckle 119, to the male buckle 165, through the attachment line 167 of cover 150, to the female buckle 166 and into the male portion 119b of buckle 119.

The above description is intended in an illustrative rather than a restrictive sense and variations to the specific configuration and materials described may be apparent to skilled persons in adapting the present invention to specific applications. Such variations are intended to form part of the present invention insofar as they are within the spirit and scope of the claims below.

We claim:

1. A bag to be carried by a human being, said bag comprising a housing having upper, lower, side, front and back surfaces and at least one compartment having at least one openable flap having closure means thereon for attachment to at least one of said surfaces of said bag, a harness attachable to said bag to assist in carrying said bag and a cover, said cover constructed of a flexible water resistant material and having a hinged edge portion and a free edge portion, said hinged portion connecting said cover to said bag, said bag comprising a closable pocket adapted to contain said cover when said cover is folded and said hinge portion located within said pocket, and wherein said cover is adapted to substantially enclose said bag on at least the top surface and said at least one surface of said bag having said openable flap thereon while not covering said harness, said free edge portion of said cover including an elasticized portion for conforming said cover on said bag when unfolded and placed on said bag.

2. The bag of claim 1 wherein said free edge portion of said cover further includes a second portion, said second portion comprising complementary fasteners so that said second portion may be affixed together.

3. The bag of claim 2 wherein said complementary fasteners includes hook and loop fasteners.

4. The bag of claim 1 wherein said free edge portion of said cover when unfolded and applied to said bag surrounds only a portion of at least one surface of said bag to create a panel adjacent said portion which is not covered.

5. The bag of claim 4 further comprising means for affixing a load carrying strap to said bag at said panel which is not covered.

6. The bag of claim 5 wherein said strap is a belt adapted to pass around the waist of said human being such that said bag with said cover in place is supported on the human being at least in part by said belt.

7. The bag of claim 1 wherein the elasticized portions is substantially along the entire free edge portion of said cover.

8. The bag of claim 7 wherein said cover further comprises an elastomeric band having two ends, said band attached to said free edge portion of said cover at each of said two ends.

9. The bag of claim 1 wherein said cover includes at least two apertures in said cover, said apertures are located and sized so that said harness may extend through said apertures when said harness is attached to said bag when said cover is applied to said bag.

10. The bag of claim 9 wherein said cover further comprises an elastomeric band having two ends, said band attached to said free edge portion of said cover at each of said two ends.

11. The bag of claim 10 wherein said bag is a shoulder bag.

12. The bag of claim 10 wherein said bag is a fanny pack.

* * * * *